US005318710A

United States Patent [19]

Campbell

[11] Patent Number: 5,318,710

[45] Date of Patent: Jun. 7, 1994

[54] LOW VISCOSITY GROUP II METAL OVERBASED SULFURIZED $C_{16}$ TO $C_{22}$ ALKYLPHENATE COMPOSITIONS

[75] Inventor: Curtis B. Campbell, Hercules, Calif.

[73] Assignee: Chevron Research and Technology Company, San Francisco, Calif.

[21] Appl. No.: 31,222

[22] Filed: Mar. 12, 1993

[51] Int. Cl.[5] ..... C10M 159/22

[52] U.S. Cl. ..... 252/25; 252/39; 252/40.007; 252/42.007

[58] Field of Search ..... 252/18.38, 39, 42.7, 252/40.7, 25

[56] References Cited

U.S. PATENT DOCUMENTS 3,169,987 2/1965 Bloch .
3,172,892 3/1965 Le Suer .
3,178,368 4/1965 Hanneman .
3,219,666 11/1965 Norman et al. .
3,367,867 2/1968 Abbot et al. .
3,390,080 6/1968 Groszek .
3,390,082 6/1968 Le Suer .
3,483,262 12/1969 Alul et al. .
3,487,023 12/1969 Sweeney .
3,576,896 4/1971 Luberoff et al. .
3,647,899 3/1972 Straus .
3,666,825 5/1972 Torck et al. .
3,705,202 12/1972 Massie .
3,775,325 11/1973 Kerfoot et al. .
4,219,686 8/1980 Petrillo et al. .
4,234,435 11/1980 Meinhard et al. .
4,251,379 2/1981 Le Coent et al. .
4,302,342 11/1981 Demoures et al. .
4,328,111 5/1982 Watson et al. .
4,358,628 11/1982 Slaugh .
4,435,301 3/1984 Brannen et al. .
4,549,607 10/1985 Morita et al. .
4,597,879 7/1986 Morita et al. .
4,608,184 8/1986 Chang .
4,612,132 9/1986 Wollenberg et al. .
4,664,824 5/1987 Chang .
4,744,921 5/1988 Liston .
4,834,900 5/1989 Soldanski et al. .
4,856,589 8/1989 Kuhlman et al. .
4,865,754 9/1989 Chang .
4,929,584 5/1990 Slaugh .
4,950,810 8/1990 Kinishi et al. .
4,971,710 11/1990 Liston .
4,973,411 11/1990 Jao et al. .
5,024,773 6/1991 Liston ..... 252/42.7
5,069,804 12/1991 Marsh et al. .
5,087,793 2/1992 Akiyama et al. .
5,162,085 11/1992 Cane et al. ..... 252/18
5,178,781 1/1993 Hori et al. ..... 252/25
5,223,163 6/1993 Coolbaugh ..... 252/18

FOREIGN PATENT DOCUMENTS 2606105 8/1976 Fed. Rep. of Germany .

*Primary Examiner*—Jacqueline V. Howard
*Attorney, Agent, or Firm*—Burns, Doane, Swecker & Mathis

[57] ABSTRACT

Disclosed are Group II metal overbased sulfurized alkylphenate compositions and in particular to Group II metal overbased sulfurized alkylphenate compositions derived from alkylphenols enriched in alkyl substituents attached to the phenol ring in a "skewed" position.

20 Claims, 1 Drawing Sheet

LOW VISCOSITY GROUP II METAL OVERBASED SULFURIZED $C_{16}$ TO $C_{22}$ ALKYLPHENATE COMPOSITIONS

BACKGROUND OF THE INVENTION

1. Field of the Invention

This invention is directed to Group II metal overbased sulfurized alkylphenate compositions and, in particular, to Group II metal overbased sulfurized alkylphenate compositions derived from alkylphenols enriched in substantially straight chain $C_{16}$ to $C_{22}$ alkyl substituents attached to the phenol ring in a "skewed" position.

2. State of the Art

The operation of diesel and spark ignition internal combustion engines is typically accompanied by the formation of sludge, lacquer and resinous deposits which adhere to the moving engine parts and thereby reduce engine efficiency. In order to prevent or reduce the formation of these deposits, a wide variety of chemical additives have been developed for incorporation into lubricating oils. These additives are commonly referred to as detergents and dispersants. Dispersants have the ability to keep deposit forming materials suspended in the oil so as to retard deposit formation during engine operation. Detergents have the ability to remove preexisting deposits from the engine during engine operation.

Among the many additives which have been developed for this purpose, Group II metal overbased sulfurized alkylphenate compositions have been found to be highly effective detergent/dispersants for use in lubricating oils. Furthermore, these additives are excellent oxidation and corrosion inhibitors and, by virtue of their alkalinity reserve, have the ability to neutralize acidic combustion and oxidation products. Such acidic products form during engine operation, particularly when operated on high sulfur containing fuels, and tend to accumulate in the lubricating oil. The ability of Group II metal overbased sulfurized alkylphenate compositions to neutralize such acidic products can be directly measured by determining the total base number (TBN) of the composition. Higher TBNs reflect a greater capacity for these compositions to neutralize acids generated during engine operation.

The preparation of Group II metal overbased sulfurized alkylphenate compositions is well known in the art and is described in detail in, for example, U.S. Pat. Nos. 3,178,368; 3,367,867; and 4,744,921, each of which is incorporated herein by reference in its entirety. Typically, such Group II metal overbased sulfurized alkylphenate compositions are prepared by treating alkyphenol in a suitable diluent (e.g., a lubricating oil) with an amount of an alkaline earth metal hydroxide, oxide and/or alkoxide in excess of that necessary to neutralize the phenol and then sulfurizing the resulting product optionally in the presence of a sulfurizing catalyst. The sulfurized product is then optionally treated with carbon dioxide to provide for the Group II metal overbased sulfurized alkylphenate composition.

Such Group II metal overbased sulfurized alkylphenate compositions are additive compositions which are used to prepare a fully formulated lubricant composition suitable for use in an internal combustion engine. Typically, the additive composition is prepared as a concentrate and is then shipped to a point where it is used to prepare fully formulated lubricant compositions by combining requisite amounts of several additive compositions, including a Group II metal overbased sulfurized alkylphenate composition, to a base stock.

In order to reduce shipping costs, the Group II metal overbased sulfurized alkylphenate composition is preferably prepared to contain as little diluent as possible. Additionally, in order to achieve the maximum amount of acid neutralization possible, the Group II metal overbased sulfurized alkylphenate composition is preferably prepared to contain as high a TBN as possible. However, because of viscosity considerations, these constraints cannot be totally satisfied and a balancing of the TBN and the amount of diluent employed with the viscosity of the Group II metal overbased sulfurized alkylphenate composition is required.

Specifically, when the amount of diluent is decreased, the viscosity of the composition is increased. Likewise, at constant diluent concentrations, increasing the TBN of the Group II metal overbased sulfurized alkylphenate compositions by using incremental amounts of alkaline earth metal oxide and/or hydroxide and/or alkoxide optionally in the presence of carbon dioxide is accompanied by increases in the viscosity of the composition. When the viscosity of the composition becomes too great, the composition becomes difficult to use in formulation procedures primarily because of handling problems. When this occurs, the viscosity of the composition must be reduced and this can be accomplished either during its manufacture by reducing the amount of carbon dioxide and alkaline earth metal oxide, hydroxide or alkoxide employed or after its manufacture by adding additional diluent.

Thus, while Group II metal overbased sulfurized alkylphenate compositions produced in the prior art are reported to possess TBNs of up to about 350 or more, in practice, commercial Group II metal overbased sulfurized alkylphenate compositions typically have a TBN of less than about 300, and more typically less than about 275, so as to ensure that the composition possesses acceptable viscosity.

In view of the above, it would be particularly desirable to reduce the viscosity of Group II metal overbased sulfurized alkylphenate compositions. In particular, such reductions would mean that at constant viscosity, a higher TBN could be achieved or at constant TBN, a lower viscosity could be achieved.

In this regard, Liston, U.S. Pat. No. 4,744,921, discloses that, at constant TBN, the use of a sulfurization catalyst during synthesis of the Group II metal overbased sulfurized alkylphenate composition reduces the viscosity of the composition as compared to the viscosity of the composition prepared without a sulfurization catalyst. However, notwithstanding the reductions achieved by using such sulfurization catalysts, it would be particularly beneficial to provide for alternative methods to reduce the viscosity of the Group II metal overbased sulfurized alkylphenate compositions or to provide for any incremental reductions in the viscosity of these compositions.

SUMMARY OF THE INVENTION

This invention is directed to the novel and unexpected discovery that Group II metal overbased sulfurized alkylphenate compositions derived from alkylphenols having a substantially straight chain $C_{16}$ to $C_{22}$ alkyl substituent attached to the phenol ring in a "skewed" position possess lower viscosity at equivalent TBN than Group II metal overbased sulfurized alkylphenate compositions derived from alkylphenols containing either branched or substantially straight chain $C_{16}$ to $C_{22}$ alkyl substituents which are attached to the phenol ring in either an end attachment or a middle attachment.

Additionally, this invention is also based, in part, on the discovery that Group II metal overbased sulfurized alkylphenate compositions derived from alkylphenols having substantially straight chain $C_{16}$ to $C_{22}$ alkyl groups attached to the phenol in a skewed position possess enhanced oil solubility and are expected to possess improved compatibility with other additives typically employed in a fully formulated lubricating oil composition (e.g., neutral or overbased alkali or alkaline earth metal hydrocarbyl sulfonates).

Accordingly, in one of its composition aspects, this invention is directed to Group II metal overbased sulfurized alkylphenate compositions derived from alkylphenols enriched in alkylphenols of formula I:

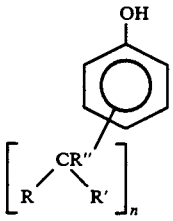

I wherein the —CRR'R" alkyl substituent is substantially straight chain, R and R' are alkyl groups of at least 3 carbon atoms, R" is hydrogen, methyl or ethyl and wherein the sum of the number of carbon atoms in R, R' and R" is from 15 to 21 and further wherein the number of carbon atoms in R' is at least 4 greater than the number of carbon atoms in R; and n is from 1 to 2.

In a preferred embodiment, the number of carbon atoms in R, R' and R" is from 17 to 21 and even more preferably, R" is hydrogen or methyl.

In still another preferred embodiment, the Group II metal overbased sulfurized alkylphenate composition is overbased with carbon dioxide and calcium oxide, calcium hydroxide or calcium alkoxide having from 1 to 6 carbon atoms.

In another of its composition aspects, this invention is directed to a lubricating oil composition comprising:

(a) an oil of lubricating viscosity;

(b) from about 1 to 20 weight percent of an alkenyl succinimide or alkenyl succinate or mixtures thereof;

(c) about 0.1 to about 4 weight percent of a Group II metal salt of a dihydrocarbyl dithiophosphoric acid;

(d) about 0.3 to about 10 weight percent of a neutral or overbased alkali or alkaline earth metal hydrocarbyl sulfonate or mixtures thereof; and (e) about 0.5 to about 40 weight percent of a Group II metal overbased sulfurized alkylphenate composition derived from alkylphenols enriched in alkylphenols of formula I:

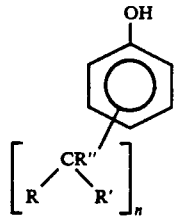

I wherein the —CRR'R" alkyl substituent is substantially straight chain, R and R' are alkyl groups of at least 3 carbon atoms, R" is hydrogen, methyl or ethyl and wherein the sum of the number of carbon atoms in R, R' and R" is from 15 to 21 and further wherein the number of carbon atoms in R' is at least 4 greater than the number of carbon atoms in R; and n is from 1 to 2.

In one of its method aspects, this invention is directed to a method for the preparation of a Group II metal overbased sulfurized alkylphenate composition which method comprises reacting in an inert diluent an alkylphenol, sulfur, a Group II metal oxide, hydroxide or $C_1$–$C_6$ alkoxide, a $C_2$–$C_4$ alkylene glycol, an alkanol of at least 8 carbon atoms and a compound selected from the group consisting of an oil-soluble Group II metal neutral or overbased hydrocarbyl sulfonate, an alkenyl succinimide and mixtures thereof followed by reaction with carbon dioxide wherein said alkylphenol is enriched in alkylphenols of formula I:

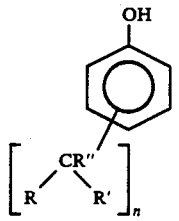

I wherein the —CRR'R" alkyl substituent is substantially straight chain, R and R' are alkyl groups of at least 3 carbon atoms, R" is hydrogen, methyl or ethyl, and wherein the sum of the number of carbon atoms in R, R' and R" is from 15 to 21 and further wherein the number of carbon atoms in R' is at least 4 greater than the number of carbon atoms in R; and n is from 1 to 2.

In another of its method aspects, this invention is directed to a method for the preparation of Group II metal overbased sulfurized alkylphenate compositions which method comprises:

(a) combining into an inert hydrocarbon diluent an alkylphenol enriched in alkylphenols of formula I:

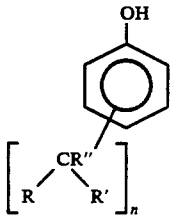

I where the —CRR'R" alkyl substituent is substantially straight chain, R and R' are alkyl groups of at least 3 carbon atoms, R'' is hydrogen, methyl or ethyl and wherein the sum of the number of carbon atoms in R, R' and R'' is from 15 to 21 and further wherein the number of carbon atoms in R' is at least 4 greater than the number of carbon atoms in R, and n is from 1 to 2;

an alkanol of at least 8 carbon atoms;

a compound selected from the group consisting of an oil-soluble Group II metal neutral or overbased hydrocarbyl sulfonate, an alkenyl succinimide, and mixtures thereof wherein the alkenyl succinimide or the oil-soluble Group II metal neutral or overbased hydrocarbyl sulfonate is employed at from about 1 to 20 weight percent to the alkylphenol and the alkanol of at least 8 carbon atoms is employed at a molar ratio of from about 0.5 to about 5 to the alkylphenol;

(b) heating the system to a temperature of from about 50° C. to about 155° C.;

(c) combining into the reaction system a Group II metal oxide, hydroxide or $C_1$–$C_6$ alkoxide while maintaining a temperature of from 50° C. to about 185° C. and then removing at least about 15 percent of the theoretical water present in the composition wherein the Group II metal oxide, hydroxide or $C_1$–$C_6$ alkoxide is employed at a molar ratio of from about 1 to about 4 to the alkylphenol;

(d) combining into the reaction system sulfur at a temperature sufficient to effect sulfurization of the alkylphenol followed by addition at from about 120° C. to about 185° C. of a $C_2$–$C_4$ alkylene glycol; wherein sulfur is employed at a molar ratio of from about 1 to about 4 to the alkylphenol, and the $C_2$–$C_4$ alkylene glycol is employed at a molar ratio of from about 1 to about 4 to the alkylphenol;

(e) heating at a temperature sufficient to effect removal of at least a portion of the water in the system;

(f) heating the system to a temperature of from about 150° C. to about 195° C.;

(g) combining into the reaction system carbon dioxide wherein carbon dioxide is employed at a molar charge of from about 1 to 3 to the alkylphenol; and (h) heating the system under reduced pressure at a temperature and pressure sufficient to remove at least a portion of the water, $C_2$–$C_4$ alkylene glycol and the alkanol of at least 8 carbon atoms.

Optionally, the methods of this invention further comprise the addition of a sulfurization catalyst prior to the sulfurization step. When employed, the sulfurization catalyst is employed at a concentration of from about 0.5 to about 10 weight percent based on the weight of the alkylphenol.

In a preferred embodiment, the substantially straight chain $C_{16}$ to $C_{22}$ alkylphenol enriched in skewed attachment is derived from a substantially straight chain internal olefin. In one embodiment, the substantially straight chain olefin employed is a mixture of olefins enhanced in internal olefins a majority of which mixture comprises one or more $C_{16}$ to $C_{22}$ olefins. For example, one commercial source of substantially straight chain olefins suitable for use in this invention is a mixture of $C_{18}$ to $C_{24}$ alpha olefins wherein the $C_{18}$ to $C_{22}$ components comprise about 94 weight percent of the olefin mixture. This alpha olefin mixture can then be isomerized, as described below, to provide for isomerized olefins with a portion of the unsaturation at a carbon atom which corresponds to a skewed position when alkylated to phenol.

DETAILED DESCRIPTION OF THE PREFERRED EMBODIMENTS

Figure 1:
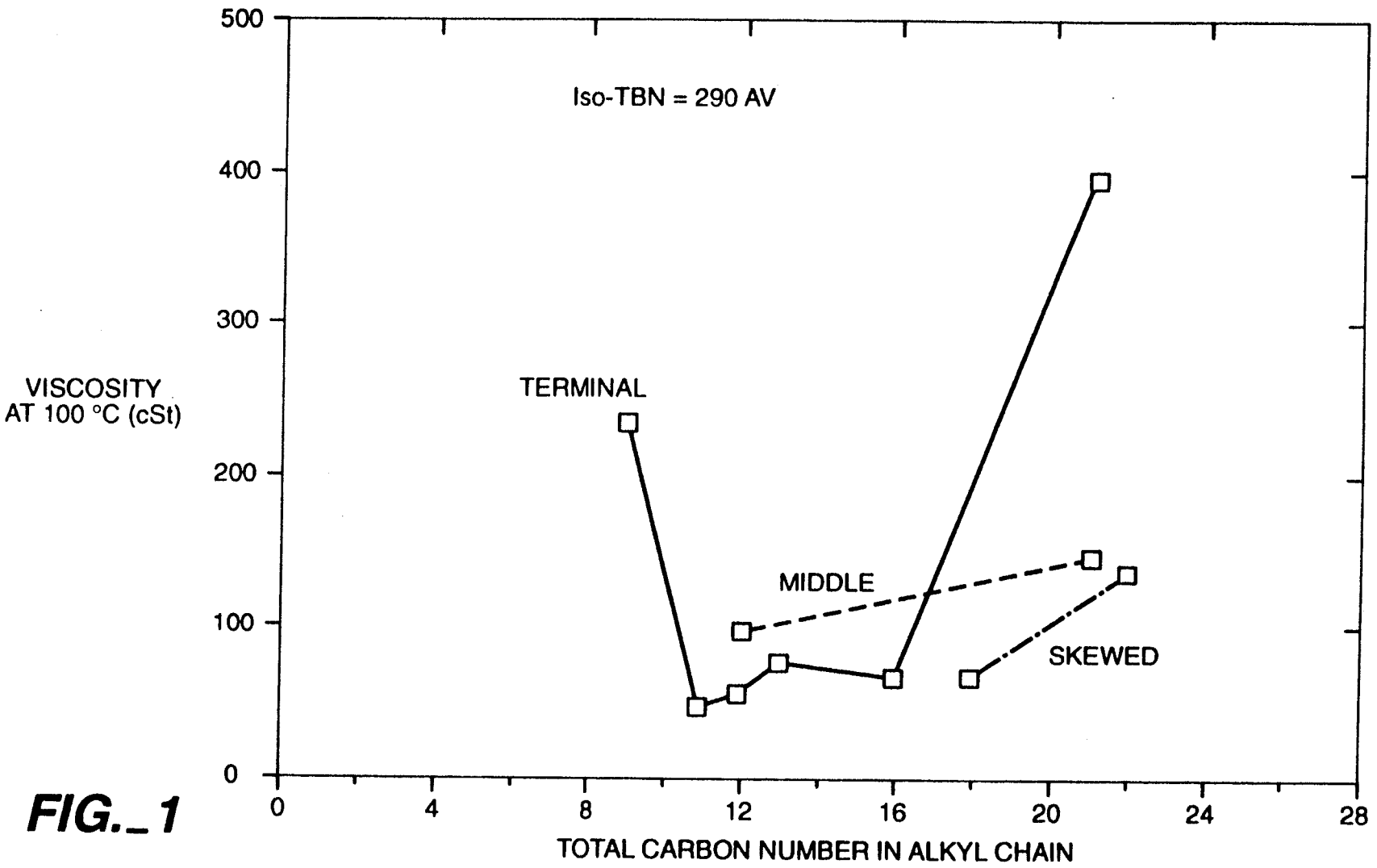
FIG. 1 illustrates the correlation of viscosity at a temperature of 100° C. of the Group II metal overbased sulfurized alkylphenate composition with the alkylphenol used to prepare this composition as it relates both to carbon number of the alkyl group as well as whether the alkyl group is attached via an end (terminal), skewed or middle attachment.

As noted above, this invention is directed to the discovery that the viscosity of Group II metal overbased sulfurized alkylphenate compositions can be lowered by deriving such compositions from alkylphenols enriched in substantially straight chain $C_{16}$ to $C_{22}$ alkyl substituents attached to the phenol ring in a skewed position.

Definitions

As used herein, the following terms have the following meanings:

The term "Group II metal" means calcium, barium, magnesium, and strontium. Preferably, the Group II metal is selected from the group consisting of calcium, magnesium, barium, and mixtures thereof. Most preferably, the Group II metal is calcium.

The term "Total Base Number" or "TBN" refers to the amount of base equivalent to milligrams of KOH in 1 gram of sample. Thus, higher TBN numbers reflect more alkaline products and therefore a greater alkalinity reserve. The TBN of an overbased sulfurized Group II metal phenate can be readily determined by ASTM test number D2896.

The term "substantially straight chain" refers to alkyl groups, olefins, and alkanols (i.e., ROH where R is alkyl) wherein at least 80 number percent of the carbon atoms in the alkyl groups, olefins, and alkanols are either primary (—$CH_3$) or secondary (>$CH_2$) carbon atoms.

Accordingly, alkyl groups and alkanols containing some trisubstituted and/or tetrasubstituted carbon atoms will nevertheless be "substantially straight chain" if a sufficient number of the remaining carbon atoms are primary (—$CH_3$) or secondary (>$CH_2$) such that at least 80 number percent of the total carbon atoms in the alkyl or alkanol are primary or secondary [e.g., the alkanol 1-methylhexan-1-ol (i.e., $$CH_3CH_2CH_2CH_2CH_2\overset{\overset{\displaystyle CH_3}{|}}{C}HOH)$$

is substantially straight chain because six of the seven carbon atoms (or 86 number percent) present in this alkanol are primary or secondary carbon atoms].

Likewise, vinyl and vinylidine olefins are substantially straight chain if a sufficient number of the carbon atoms in these olefins are primary or secondary such that at least 80 number percent of the total carbon atoms in these olefins are primary (—$CH_3$) or secondary (>$CH_2$) [e.g., the vinylidine olefin

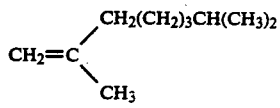

is substantially straight chain because eight of the ten carbon atoms (or 80 number percent) present in this olefin are either $>CH_2$ or $—CH_3$ groups].

The alkylphenols of Formula I are sometimes referred to herein as "substantially straight chain alkylphenols" and this refers merely to the fact that the —CRR'R" alkyl substituent on the alkylphenol is substantially straight chain. As is apparent, such substantially straight chain alkyl substituents on alkylphenols can be prepared by alkylating phenol with a substantially straight chain olefin or alkanol.

The term "skewed attachment" refers to alkylphenols of the formula:

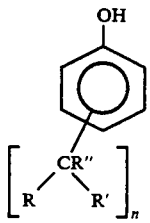

wherein R" is hydrogen, methyl or ethyl and R and R' are alkyl groups of at least 3 carbon atoms and further wherein the number of carbon atoms in R' is at least 4 greater than the number of carbon atoms in R; and n is from 1 to 2. In the case of $C_{16}$ to $C_{22}$ alkylphenols, the sum of R, R' and R" is from 15 to 21 carbon atoms.

The term "end (or terminal) attachment" refers to alkylphenols of the formula:

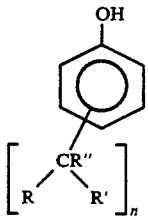

wherein R is hydrogen or an alkyl group of no more than 2 carbon atoms, R" is hydrogen, methyl or ethyl and R' is an alkyl group, and n is from 1 to 2. In the case of $C_{16}$ to $C_{22}$ alkyl groups, the sum of the number of carbon atoms in R, R' and R" is from 15 to 21.

The term "middle attachment" refers to alkylphenols of the formula:

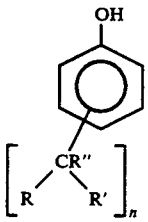

wherein R" is hydrogen, methyl or ethyl and R and R' are alkyl groups of at least 3 carbon atoms and the difference in the number of carbon atoms between R and R' is no more than 3, and n is one or two. In the case of $C_{16}$ to $C_{22}$ alkyl groups, the sum of the number of carbon atoms in R, R' and R" is from 15 to 21.

The term "enriched in skewed attachment" means that the number distribution of alkyl groups attached to the phenol ring via a skewed attachment in the Group II metal overbased sulfurized alkylphenate composition is greater than that which would be achieved via a statistical distribution. For example, when the alkyl group is a linear $C_{16}$ group attached at different points to the phenol and R" is hydrogen, a statistical distribution of alkyl substituents as set forth in formula I would be as follows:

| $R_1$ | No. of Carbon Atoms in Attachment Type[1] | $R_2$ |
|---|---|---|
| 0 | end | 15 |
| 1 | end | 14 |
| 2 | end | 13 |
| 3 | skewed | 12 |
| 4 | skewed | 11 |
| 5 | skewed | 10 |
| 6 | middle | 9 |
| 7 | middle | 8 |
| 8 | middle | 7 |
| 9 | middle | 6 |
| 10 | skewed | 5 |
| 11 | skewed | 4 |
| 12 | skewed | 3 |
| 13 | end | 2 |
| 14 | end | 1 |
| 15 | end | 0 |

[1]The terms end, skewed and middle refer to the attachment of the alkyl group to the phenol ring and have the definitions defined above with the exception that the smaller of $R_1$ and $R_2$ is referred to as the R substituent in Formula I above and the larger of $R_1$ and $R_2$ is referred as the R' substituent in Formula I above.

As is apparent, a statistical distribution of the alkyl substitution to the phenol ring for such a linear $C_{16}$ alkyl group would provide for only 37.5% skewed attachment. Accordingly, in order to be enriched in skewed attachment, such a linear $C_{16}$ alkyl substituent would need to have more than 37.5% of the alkyl substituents attached to the phenol ring in skewed attachment.

Preferably, the amount of skewed attachment of the alkyl group to the phenol ring is at least 5% more than a statistical distribution and more preferably at least 7.5% more than a statistical distribution.

As is apparent, the alkyl substituent of the alkylphenols of Formula I have, by definition, skewed attachment. Thus, the term "enriched in alkylphenols of formula I" means "enriched in skewed attachment".

The term "Group II metal overbased sulfurized alkylphenate compositions" refer to compositions comprising a diluent (e.g., lubricating oil) and a highly alkaline sulfurized alkylphenate wherein the alkalinity is provided by carbon dioxide and a Group II metal base in excess of that required for neutralization of the sulfurized alkylphenol.

The term "conventional Group II metal overbased sulfurized alkylphenate compositions" refer to Group II metal overbased sulfurized alkylphenate compositions which do not contain alkylphenol enriched in alkylphenols of Formula I above.

Methodology

The Group II metal overbased sulfurized alkylphenate compositions described herein can be prepared by reacting in an inert hydrocarbon diluent appropriate amounts of sulfur, alkylphenol, a Group II metal oxide, hydroxide or $C_1$–$C_6$ alkoxide followed by carbonation with $CO_2$. The reaction system will also contain a $C_2$–$C_4$ alkylene glycol (such as 1,3-propylene glycol, 1,4-butylene glycol, ethylene glycol, etc., but preferably the $C_2$–$C_4$ alkylene glycol is ethylene glycol), a high molecular weight alkanol, i.e., an alkanol of at least 8 carbon atoms, and a compound selected from the group consisting of a Group II metal neutral or overbased hydrocarbyl sulfonate, an alkenyl succinimide and mixtures thereof.

The reaction can also optionally employ a sulfurization catalyst which catalyzes the sulfur incorporation onto the alkylphenol. Suitable sulfurization catalysts are disclosed in U.S. Pat. No. 4,744,921 which is incorporated herein by reference in its entirety.

In this reaction, sulfur is generally employed at from about 1.5 to 4 moles per mole of the alkylphenol in the reaction system; preferably at from about 2 to 4 moles per mole of the alkylphenol and even more preferably at from about 2 to 3 moles per mole of alkylphenol. All allotropic forms of sulfur can be used. Alternatively, in place of sulfur, sulfur monochloride may be employed. For the purposes of this invention, sulfur monochloride is considered equivalent to sulfur. The sulfur may be employed either as molten sulfur or as a solid.

The Group II metal oxide, hydroxide or $C_1$–$C_6$ alkoxide used to prepare the Group II metal overbased sulfurized alkylphenate compositions of this invention includes the oxides, hydroxides and alkoxides of calcium, strontium, magnesium or barium. However, calcium, barium and magnesium are preferred whereas calcium is most preferred. The Group II metal oxide, hydroxide, or $C_1$–$C_6$ alkoxide is employed at a molar charge of from about 1.5 to about 4 per mole of alkylphenol; although preferably at from greater than 2 to 4; and even more preferably from greater than 2 to 3 per mole of alkylphenol.

Carbon dioxide is employed in the reaction system in conjunction with the Group II metal oxide, hydroxide or $C_1$–$C_6$ alkoxide to form overbased products and is generally employed from about 1 to about 3 moles per mole of alkylphenol, although preferably from about 2 to about 3 moles per mole of alkylphenol charged to the reaction system. Preferably, the amount of $CO_2$ incorporated into the Group II metal overbased sulfurized alkylphenate provides for a $CO_2$ to calcium weight ratio from between about 0.65:1 to about 0.73:1.

When a sulfurization catalyst is employed, it is typically employed at from about 0.5 to 10 weight percent to the alkylphenol in the reaction system and preferably at from about 1 to 2 weight percent. In a preferred embodiment, the sulfurization catalyst is added to the reaction mixture as a liquid. This can be accomplished by dissolving the sulfurization catalyst in molten sulfur or in the alkylphenol as a premix to the reaction.

The alkylphenol employed in this invention comprises substantially straight chain alkyl substituents of from 16 to 22 carbon atoms which are enriched in skewed attachment to the phenol ring as represented by the alkylphenols of formula I:

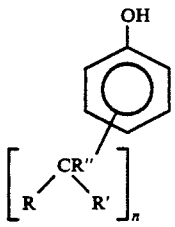

I wherein the —CRR'R" alkyl substituent is substantially straight chain, R" is hydrogen, methyl or ethyl, R and R' are alkyl groups of at least 3 carbon atoms such that the sum of the number of carbon atoms in R, R' and R" is from 15 to 21 and further wherein the number of carbon atoms in R' is at least 4 greater than the number of carbon atoms in R; and n is from 1 to 2.

In a preferred embodiment, the substantially straight chain $C_{16}$ to $C_{22}$ alkyl substituent of the alkylphenol enriched in skewed attachment is derived from a substantially straight chain internal olefin or alkanol having its unsaturation or alcohol substituent at a carbon atom corresponding to a skewed position in the alkyl substituent.

Suitable substantially straight chain olefin or alkanol mixtures are commercially available or can be prepared by art recognized procedures. For example, incubation of a substantially straight chain alpha olefin over acidic alkylation catalysts, metal catalysts, and the like, will result in isomerization of the double bond to the internal carbon atoms and an enhancement of the amount of internal olefins having their unsaturation at a carbon atom corresponding to a skewed position in the alkyl substituent. Examples of acidic alkylation catalysts include Amberlyst 15 sulfonic acid resin catalyst and Amberlyst 36 sulfonic acid resin catalyst (both of which are available from Rohm & Haas, Philadelphia, Pa.); and examples of metal catalysts include rhodium trichloride, iron pentacarbonyl, and the like. Other methods for preparing internal olefins include those disclosed in U.S. Pat. No. 5,087,793, which patent is incorporated herein by reference in its entirety.

Alternatively, specific substantially straight chain alkanols can be prepared by art recognized procedures as illustrated in reaction (1) below:

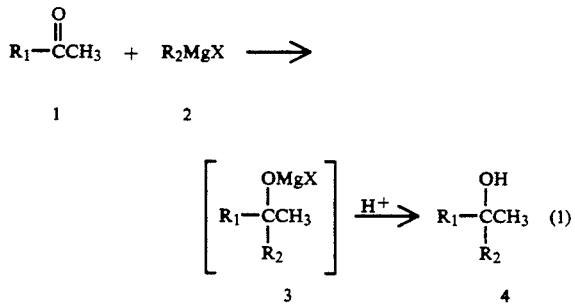

(1)

wherein $R_1$ and $R_2$ are alkyl groups such that the alkanol 4 is substantially straight chain and X is a halogen (e.g., chloro or bromo). The reaction is well documented in the art and involves reaction of ketone 1 with Grinard reagent 2 under suitable reaction conditions to provide for intermediate 3 which upon hydrolysis yields alkanol 4. Alkanol 4 can be used directly in the alkylation of phenol. Alternatively, in the presence of an acid, alkanol 4 will lose water resulting in the formation of a substantially straight chain olefin.

When $R_1$ and $R_2$ are appropriately selected, then the resulting substantially straight chain alkanol or olefin has its alcohol substituent or its unsaturation at a carbon atom corresponding to a skewed position (e.g., $$CH_3(CH_2)_{12}CH{=}\underset{\underset{CH_3}{|}}{C}(CH_2)_5CH_3 \quad \text{or}$$

$$CH_3(CH_2)_{12}CH_2\underset{\underset{OH)}{|}}{CH}(CH_2)_5CH_3$$

The alkylphenols of formula I above are then prepared by reacting an appropriate substantially straight chain olefin (or alkanol) or olefin (or alkanol) mixture with phenol in the presence of an alkylating catalyst at a temperature of from about 60° C. to 200° C., preferably 110° C. to 180° C. and more preferably from 120° C. to 145° C. either neat or in an essentially inert solvent at atmospheric pressure using methods which favor the formation of skewed attachment.

One method for favoring the formation of skewed attachment is the use of a trisubstituted olefin (e.g., a vinylidene olefin) or a tertiary alkanol (i.e., an alkanol which contains its —OH substituent at an otherwise tertiary carbon atom, e.g., $$\begin{array}{c} C \\ | \\ C-\underset{\underset{C}{|}}{C}-OH) \end{array}$$

wherein the unsaturation or —OH substituent is on a carbon atom which would translate to a skewed position on the alkyl substituent of the alkylphenol and wherein the olefin or alkanol contains few or no other tertiary carbon atoms. Under these conditions, almost all of the alkyl substituent in the resulting alkylphenol is attached to the phenol at the tertiary carbon atom site.

When the olefin (or alkanol) employed contains its unsaturation (or —OH substituent) at a secondary carbon atom and the olefin (or alkanol) contains no tertiary carbon atoms, then the method for favoring formation of skewed attachment include the use of an olefin (or alkanol) having its unsaturation (or —OH substituent) at a carbon atom which would translate to a skewed position on the alkyl substituent of the alkylphenol combined with the use of alkylating conditions which favor skewed attachment. In other words, the alkylating conditions are manipulated so as to provide alkyl groups on the alkylphenols which are enriched in skewed attachments. Suitable reaction conditions for the formation of skewed attachment include use of lower reaction temperatures and/or the use of lower amounts of alkylation catalyst and/or lower charge mole ratios of phenol to olefin, and the like.

A preferred catalyst for alkylating the phenol with the appropriate substantially straight chain olefin or alkanol is a sulfonic acid resin catalyst such as Amberlyst 15® or Amberlyst 36® both of which are commercially available from Rohm and Hass, Philadelphia, Pa. In the alkylation reaction, molar ratio of reactants may be used. Alternatively, molar excess of phenol can be employed, e.g., 2–2.5 equivalents of phenol for each equivalent of olefin or alkanol with unreacted phenol recycled. The latter process maximizes monoalkylphenol. Examples of inert solvents include benzene, toluene, chlorobenzene and Chevron 250 thinner (available from Chevron U.S.A., Inc., San Francisco, Calif.) which is a mixture of aromatics, paraffins and naphthenes.

The resulting alkylated product is a mixture of monoalkylated and dialkylated phenols. In turn, the resulting monoalkylphenols are either ortho alkylphenols of the formula:

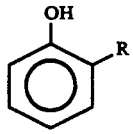

or para-alkylphenols of the formula:

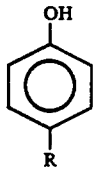

whereas the dialkylphenols are typically 2,4-dialkylated phenols. On the other hand, any 2,6-dialkylated phenols formed are essentially inert products since these products are not able to be sulfurized and subsequently overbased.

Preferably, the alkylphenols are monoalkylphenols (i.e., n=1) and more preferably the monoalkylphenols are para-monoalkylphenols.

The reaction to prepare the Group II metal overbased sulfurized alkylphenates of this invention also employs a $C_2$–$C_4$ alkylene glycol, preferably ethylene glycol, a high molecular weight alkanol (generally $C_8$ to $C_{16}$, e.g., decyl alcohol) and a compound selected from the group consisting of Group II metal neutral or overbased hydrocarbyl sulfonates and alkenyl succinimides.

The $C_2$–$C_4$ alkylene glycol is generally employed at a molar charge of about 1 to 4 per mole of alkylphenol, although preferably this molar charge is from about 1.8 to 3. Alternatively, 2-ethylhexanol may be employed in conjunction with the $C_2$–$C_4$ alkylene glycol at weight ratios such as 80% by weight 2-ethylhexanol and 20% by weight ethylene glycol.

The high molecular weight alkanol is employed at a molar charge of from about 0.5 to 5 per mole of alkylphenol, although preferably from about 0.5 to 4 and even more preferably from 1 to 2. Suitable alkanols of at least 8 carbon atoms include 1-octanol, 1-decanol (decyl alcohol), 2-ethylhexanol, and the like.

The Group II metal neutral or overbased hydrocarbyl sulfonates may be either natural or synthetic hydrocarbyl sulfonates such as petroleum sulfonate, synthetically alkylated aromatic sulfonates, or aliphatic sulfonates such as those derived from polyisobutylene. These sulfonates are well-known in the art. The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates which are aromatic in character.

Certain sulfonates are typically prepared by sulfonating a petroleum fraction having aromatic groups, usually mono- or diakylbenzene groups, and then forming the metal salt of the sulfonic acid material. Other feedstocks used for preparing these sulfonates included synthetically alkylated benzenes and aliphatic hydrocarbons prepared by polymerizing a mono- or diolefin, for example, a polyisobutenyl group prepared by polymerizing isobutene. The metallic salts are formed directly or by metathesis using well-known procedures to provide for a neutral hydrocarbyl sulfonate having a TBN of no more than about 25.

The sulfonates are then overbased to yield products having Total Base Numbers up to about 400 or more by addition of an excess of a Group II metal hydroxide or oxide and optionally carbon dioxide. Calcium hydroxide or oxide is the most commonly used material to produce the basic overbased sulfonates. All of these materials are well-known in the art.

When employed, the Group II metal neutral or overbased hydrocarbyl sulfonate is employed at from about 1 to 20 weight percent to the alkylphenol, although preferably from about 1 to 10 weight percent. The Group II metal neutral or overbased hydrocarbyl sulfonate described above are also employed in lubricating oil formulations in conjunction with the Group II metal overbased sulfurized alkylphenates; especially in marine crankcase formulations.

Alternatively, in lieu of a Group II metal neutral or overbased hydrocarbyl sulfonate, an alkenyl succinimide may be employed. Alkenyl succinimides are well-known in the art. The alkenyl succinimides are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine compound. The preparation of the alkenyl succinimides has been described many times in the art. See, for example, U.S. Pat. Nos. 3,390,082; 3,219,666; and 3,172,892, the disclosure of which are incorporated herein by reference. Reduction of the alkenyl substituted succinic anhydride yields the corresponding alkyl derivative. The alkyl succinimides are intended to be included within the scope of the term "alkenyl succinimide". A product comprising predominantly mono- or bis-succinimide can be prepared by controlling the molar ratios of the reactants. Thus, for example, if one mole of amine is reacted with one mole of the alkenyl or alkyl substituted succinic anhydride, a predominantly mono-succinimide product will be prepared. If two moles of the succinic anhydride are reacted per mole of polyamine, a bis-succinimide will be prepared.

The alkenyl group of the alkenyl succinic anhydride is derived from an alkene, preferably polyisobutene, and is obtained by polymerizing an alkene (e.g., isobutene) to provide for a polyalkene which can vary widely in its compositions. The average number of carbon atoms in the polyalkene and hence the alkenyl substituent of the succinic anhydride can range from 30 or less to 250 or more, with a resulting number average molecular weight of about 400 or less to 3,000 or more. Preferably, the average number of carbon atoms per polyalkene molecule will range from about 50 to about 100 with the polyalkenes having a number average molecular weight of about 600 to about 1,500. More preferably, the average number of carbon atoms in the polyalkene molecule ranges from about 60 to about 90 and the number average molecular weight ranges from about 800 to 1,300. The polyalkene is reacted with maleic anhydride according to well-known procedures to yield the polyalkenyl substituted succinic anhydride which is referred to herein as the alkenyl substituted succinic anhydride.

In preparing the alkenyl succinimide, the substituted succinic anhydride is reacted with a polyalkylene polyamine to yield the corresponding succinimide. Each alkylene radical of the polyalkylene polyamine usually has up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case, the number of amine groups exceeds the number of alkylene groups by 1. Preferably, the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, tri(hexamethylene)tetramine, di(trimethylene)triamine), etc.

When employed the amount of alkenyl succinimide used is from about 1 to 20 weight percent to the alkylphenol, although preferably from about 1 to 10 weight percent.

The reaction to prepare Group II metal over-based sulfurized alkylphenate compositions described herein can be conducted by the following steps:

(a) combining into an inert hydrocarbon diluent an alkylphenol enriched in alkylphenols of formula I:

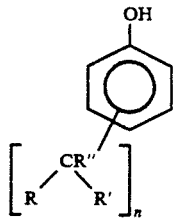

I where the —CRR'R'' alkyl substituent is substantially straight chain, R and R' are alkyl groups of at least 3 carbon atoms, R'' is hydrogen, methyl or ethyl and wherein the sum of the number of carbon atoms in R, R' and R'' is from 15 to 21 and further wherein the number of carbon atoms in R' is at least 4 greater than the number of carbon atoms in R' and n is from 1 to 2;

an alkanol of at least 8 carbon atoms;

a compound selected from the group consisting of an oil-soluble Group II metal neutral or overbased hydrocarbyl sulfonate, an alkenyl succinimide, and mixtures thereof wherein the alkenyl succinimide or the oil-soluble Group II metal neutral or overbased hydrocarbyl sulfonate is employed at from about 1 to 20 weight percent to the alkylphenol and the alkanol of at least 8 carbon atoms is employed at a molar ratio of from about 0.5 to about 5 to the alkylphenol;

(b) heating the system to a temperature of from about 50° C. to about 155° C.;

(c) combining into the reaction system a Group II metal oxide, hydroxide or $C_1$–$C_6$ alkoxide while maintaining a temperature of from 50° C. to about 185° C. and then removing at least about 15 percent of the theoretical water present in the composition. wherein the Group II metal oxide, hydroxide or $C_1$–$C_6$ alkoxide is employed at a molar ratio of from about 1 to about 4 to the alkylphenol;

(d) combining into the reaction system sulfur at a temperature sufficient to effect sulfurization of the alkylphenol followed by addition at from about 120° C. to about 185° C. of a $C_2$–$C_4$ alkylene glycol; wherein sulfur is employed at a molar ratio of from about 1 to about 4 to the alkylphenol, and the $C_2$–$C_4$ alkylene glycol is employed at a molar ratio of from about 1 to about 4 to the alkylphenol;

(e) heating at a temperature sufficient to effect removal of at least a portion of the water in the system;

(f) heating the system to a temperature of from about 150° C. to about 195° C.;

(g) combining into the reaction system carbon dioxide wherein carbon dioxide is employed at a molar charge of from about 1 to 3 to the alkylphenol; and (h) heating the system under reduced pressure at a temperature and pressure sufficient to remove at least a portion of the water, $C_2$–$C_4$ alkylene glycol and the alkanol of at least 8 carbon atoms.

Preferably, in step (a), the alkylphenol, the high molecular weight alkanol, and the oil-soluble Group II metal neutral or overbased hydrocarbyl sulfonate and/or alkenyl succinimide are combined into the diluent oil at from about 20° C. to about 35° C. and preferably at about 25° C.. metal oxide, hydroxide or $C_1$–$C_6$ alkoxide is added at a temperature of between about 40° C. and 85° C. and preferably at a temperature of about 65° C. After addition, heating is preferably continued to remove at least 15% of the theoretical water from the reaction system at a temperature of from about 120° C. to about 150° C. In step (c), the term "theoretical water" refers to the amount of any water which was added to the reaction and which has not been removed plus any water which should be formed based on the stoichiometry of the reaction and which also has not been removed. Preferably, at least 15 to 25% of the theoretical water is removed and more preferably about 19% of the theoretical water is removed.

In step (d), sulfurization is preferably effected at a temperature of from about 120° C. to 185° C. and more preferably at about 150° C.. Also, in step (d), the addition of alkylene glycol is likewise preferably conducted at from about 120° C. to 185° C. and more preferably at about 150° C..

Step (e) involves removal of a portion of the theoretical water from the system. In this step, water is generally removed from the system until at least approximately 30% of the theoretical water is removed and preferably between 30% and 55% or more of the theoretical water is removed from the system, and even more preferably, about 45% of the theoretical water is removed. In this case, the term "theoretical water" refers to the amount of any water added to the reaction and which has not been previously removed plus any water which should be formed based on the stoichiometry of the reaction and which also has not been previously removed.

Step (f) is preferably conducted at about 175° C. and during this step, between about 35 and 65% of the theoretical water is preferably removed and, more preferably, about 53%. As in step (e), the term "theoretical water" refers to the amount of any water added to the reaction and which has not been previously removed plus any water which should be formed based on the stoichiometry of the reaction and which also has not been previously removed.

Step (h) involves heating the system under reduced pressures at a temperature and pressure sufficient to remove from the system a portion of the water, $C_2$–$C_4$ alkylene glycol and the alkanol of at least 8 carbon atoms. It is understood by those skilled in the art that the temperature to remove a portion of the water, $C_2$–$C_4$ alkylene glycol and unreacted carbon dioxide is a function of pressure. That is lower temperatures require lower pressures to effect removal from the system of a portion of water, $C_2$–$C_4$ alkylene glycol and the alkanol of at least 8 carbon atoms. All that is required is a sufficiently high temperature and a sufficiently low pressure to effect removal. In general, temperatures of from greater than about 175° C. to about 200° C., and pressures from about 10 to about 50 mm of mercury or less have been found sufficient. Step (h) is generally continued until approximately all of the water, at least about 75% of the $C_2$–$C_4$ alkylene glycol, and at least about 75% of the alkanol of at least 8 carbon atoms are removed. Preferably, step (h) is continued until no additional $C_2$–$C_4$ alkylene glycol and/or alkanol of at least 8 carbon atoms is removed, i.e., distills in the overhead condenser.

The inert hydrocarbon diluent employed in this method is generally lubricating oil. Suitable lubricating oil diluent include solvent refined 100N, i.e., Cit-Con 100N, and hydrotreated 100N, i.e., RLOP 100N, etc.

In a preferred embodiment, it has been found that the addition of a demulsifier such as Triton X-45 and Triton X-100 may synergistically enhance the hydrolytic stability of the Group II metal overbased sulfurized alkylphenate. Triton X-45 and Triton X-100 are nonionic detergents useful as demulsifiers and are available from Rohm and Haas (Philadelphia, Pa). These demulsifiers are ethoxylated p-octylphenols. Other suitable demulsifiers include Igepal CO-610 available from GAF Corporation (New York, N.Y.). In one embodiment, the demulsifier and sulfurization catalyst are combined. That is the aqueous solution contains calcium polysulfide and Triton X-100. Such a product is sold by Chevron Chemical Company (San Francisco, Calif.) under the trade name of ORTHORIX®. Demulsifiers are generally added at from 0.1 to 1 weight percent to the alkylphenol, preferably at from 0.1 to 0.5 weight percent.

Utility

The Group II metal overbased sulfurized alkylphenate compositions of this invention have reduced viscosity at a particular TBN as compared to conventional Group II metal overbased sulfurized alkylphenate compositions of similar carbon number in the alkyl group of the alkylphenol used to prepare this composition. Accordingly, the Group II metal overbased sulfurized alkylphenate compositions of this invention can be used either by themselves or can be used in combination with conventional Group II metal overbased sulfurized alkylphenate compositions to lower the viscosity of such conventional phenate compositions while maintaining high TBN provided that the amount of skewed attachment in the combined composition for the substantially straight chain $C_{16}$ to $C_{22}$ components of the alkyl groups on the phenate is greater than a statistical distribution.

The combinations are typically prepared in situ by employing a substantially straight chain olefin or alkanol reagent which contains $C_{16}$ to $C_{22}$ components and components outside the range of $C_{16}$ to $C_{22}$ so that upon alkylation of phenol under conditions to provide enriched skewed attachment, the resulting alkylphenol and subsequently the resulting Group II metal overbased sulfurized alkylphenate composition contains a fraction within the scope of the claimed invention and a fraction outside the scope of the claimed invention (i.e., a conventional phenate). In one such embodiment, a commercial olefin mixture is employed which mixture comprises substantially straight chain $C_{18}$ to $C_{24}$ alpha olefins wherein the $C_{18}$, $C_{20}$ and $C_{22}$ components comprise about 94 weight percent of the olefin mixture. Such an olefin mixture is sold by Chevron Chemical Company (San Ramon, Calif.), as a $C_{20}$ to $C_{24}$ olefin and this mixture can be isomerized in the manner described above to enrich in the amount of unsaturation in the olefin which provides for a skewed attachment of the alkyl group to the phenol.

Alternatively, such combinations can be prepared by combining a conventional Group II metal overbased sulfurized alkylphenate composition with a Group II metal overbased sulfurized alkylphenate composition of this invention.

The oil-soluble, Group II metal overbased sulfurized alkylphenates produced herein, either alone or in combination with a conventional oil-soluble, Group II metal overbased sulfurized alkylphenate, are useful lubricating oil additives imparting detergency and dispersancy properties to the lubricating oil as well as providing an alkalinity reserve in the oil. When employed in this manner, the total amount of the oil-soluble, Group II metal overbased sulfurized alkylphenate ranges from about 0.5 to 40 weight percent of the total lubricant composition although preferably from about 1 to 25 weight percent of the total lubricant composition. Such lubricating oil compositions are useful in diesel engines, gasoline engines as well as in marine engines.

When employed in diesel or gasoline engines, the Group II metal overbased sulfurized alkylphenols of this invention are preferably combined into a based stock with other additives to provide for a fully formulated lubricant composition. Such a composition preferably comprises:

(a) an oil of lubricating viscosity;

(b) from about 1 to 20 weight percent of an alkenyl succinimide or alkenyl succinate or mixtures thereof;

(c) about 0.1 to about 4 weight percent of a Group II metal salt of a dihydrocarbyl dithiophosphoric acid;

(d) about 0.3 to about 10 weight percent of a neutral or overbased alkali or alkaline earth metal hydrocarbyl sulfonate or mixtures thereof; and (e) about 0.5 to about 40 weight percent of a Group II metal overbased sulfurized alkylphenate composition of this invention.

In regard to the above, the alkenyl succinimides employed in this composition act as dispersants in the lubricant compositions and include the alkenyl succinimides described above as well as those set forth in U.S. Pat. Nos. 4,612,132 and 4,234,435, both of which are incorporated by reference. Alkenyl succinates are also described in the art and are prepared from the alkenyl succinic anhydrides described above by conversion of the anhydride to an ester either directly or through the succinic acid.

The alkenyl succinimide or succinate is present in an amount of from about 1 to about 20 weight percent and preferably, from about 1 to about 10 weight percent.

The Group II metal salts of dihydrocarbyl dithiophosphoric acids exhibit wear, antioxidant and thermal stability properties. Group II metal salts of phosphorodithioic acids have been described previously. See, for example, U.S. Pat. No. 3,390,080, columns 6 and 7, wherein these compounds and their preparation are described generally. This patent is incorporated herein by reference in its entirety.

Suitable Group II metal salts of the dihydrocarbyl dithiophosphoric acids useful in the lubricating oil compositions of this invention contain from about 4 to about 12 carbon atoms in each of the hydrocarbyl radicals and may be the same or different and may be aromatic, alkyl or cycloalkyl. Preferred hydrocarbyl groups are alkyl groups containing from 4 to 8 carbon atoms and are represented by butyl, isobutyl, sec-butyl, hexyl, isohexyl, octyl, 2-ethylhexyl, and the like. The metals suitable for forming these salts include barium, calcium, strontium, zinc and cadmium of which zinc is preferred.

Preferably, the Group II metal salt of dihydrocarbyl dithiophosphoric acid has the following formula:

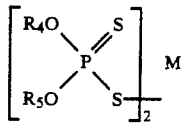

wherein $R_4$ and $R_5$ each independently represent hydrocarbyl radicals as described above; and M represents a Group II metal cation as described above.

The dithiophosphoric salt is present in the lubricating oil composition of this invention in an amount effective to inhibit engine wear and oxidation. The amounts preferably range from about 0.1 to about 4 weight percent based on the weight of the total composition and preferably from about 0.2 to about 2.5 weight percent. The final lubricating oil composition will ordinarily contain from 0.025 to 0.25 weight percent phosphorus and preferably from about 0.05 to about 0.15 weight percent.

The neutral or overbased alkali or alkaline earth metal hydrocarbyl sulfonate or mixtures thereof are employed as detergents and dispersants and include the hydrocarbyl sulfonates described above. Additionally, when the hydrocarbyl sulfonate is an overbased sulfonate, it also imparts alkaline reserve to the lubricant composition.

When employed in marine engines, the oil-soluble, Group II metal overbased sulfurized alkylphenates are often used in conjunction with an oil-soluble, Group II metal neutral or overbased hydrocarbyl sulfonate as described above. When so employed, the amount of oil-soluble, Group II metal neutral or overbased hydrocarbyl sulfonate ranges from about 0.5 to about 20 weight percent based on the total weight of the lubricant composition.

Such lubricating oil compositions employ a finished lubricating oil which may be single or multi-grade. Multigrade lubricating oils are prepared by adding viscosity index (VI) improvers. Typical viscosity index improvers are polyalkyl methacrylates, ethylene, propylene copolymers, styrene-diene copolymers, and the like. So-called decorated VI improvers having both viscosity index and dispersant properties are also suitable for use in the formulations of this invention.

The lubricating oil used in such compositions may be mineral oils or synthetic oils of viscosity suitable for use in the crankcase of an internal combustion engine such as gasoline engines and diesel engines which include marine engines. Crankcase lubricating oils ordinarily have a viscosity of about 1300 cSt at 0° F. (−18° C.) to 24 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha-olefins having the proper viscosity. Especially useful are the hydrogenated liquid oligomers of $C_6$ to $C_{12}$ alpha-olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with to 90 weight percent 150 SUS (100° F.) (28.5 cSt and 38° C.) mineral oil gives an excellent lubricating Other additives which may be present in the formulation include rust inhibitors, foam inhibitors, corrosion inhibitors, metal deactivators, pour point depressants, antioxidants, and a variety of other well-known additives.

The following examples are offered to specifically illustrate the invention. These examples and illustrations are not to be construed in any way as limiting the scope of the invention.

EXAMPLES

Example 1

Preparation of 7-Methyl-n-heneicosan-7-ol

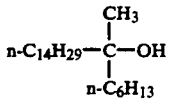

8.50 Grams of metallic magnesium was added to an oven-dried, 2 liter, 4-neck round bottom flask. Approximately 0.1 grams of iodine was then One of the four necks of the flask was then set up with a claison adapter fitted with a thermometer and a condenser with a nitrogen stream attached to the condenser. Two of the other necks were connected to 250 and 500 milliliter, oven-dried, addition funnels. The fourth neck was fitted with a mechanical stirrer.

The 500 milliliter addition funnel was fitted with a septum containing a large diameter needle in the center. The system was then flushed with nitrogen. After flushing, diethyl ether was transferred to the 500 ml addition funnel. Transfer was effected through the needle fitted in the septum of the 500 ml addition funnel by use of a commercially available needle transfer apparatus (from Aldrich Chemical Company, Milwaukee, Wis.).

Sufficient diethyl ether was then added to the round bottom flask to cover the magnesium.

At this time, 95 grams of n-tetradecyl bromide (100 grams of a 95% solution—available from Aldrich Chemical Company, Milwaukee, Wis.) was added to the 250 ml addition funnel. About 5 mls of the n-tetradecyl bromide in the 250 ml addition funnel was added to the reaction system along with about 25 ml of the diethyl ether from the 500 ml addition funnel and the system heated to reflux to initiate reaction. Once reaction was initiated, the remainder of the n-tetradecyl bromide was carefully added to ensure continued controlled reaction between the magnesium and the n-tetradecyl bromide. Control was maintained, in part, by the addition of approximately 5 ml of diethyl ether from the 500 ml addition funnel for each ml of n-tetradecyl bromide from the 250 ml addition funnel.

As needed, additional diethyl ether was charged to the 500 ml addition funnel as required by the needle transfer technique described above. In all, about 950 ml of diethyl ether was employed.

After addition of the n-tetradecyl bromide was complete, diethyl ether addition funnel, containing about 200 ml of unadded diethyl ether, was removed from the round bottom flask and the addition hole stoppered. Afterwards, the reaction system was continued to be heated at reflux for approximately 10 minutes and then cooled to about 10° C. in an ice bath to provide for the Grinard reagent, i.e., n—$C_{14}H_{29}MgBr$ as a diethyl ether solution.

Approximately 41.9 grams of n-hexyl methyl ketone [$C_6H_{13}C(O)CH_3$—2-octanone, available from Aldrich Chemical Company, Milwaukee, Wis.] was added to the 500 ml addition funnel containing 200 ml of diethyl ether (described above). The addition funnel was then returned to the 4-neck round bottom flask and the flask removed from the ice bath. The n-hexyl methyl ketone was added rather quickly to $C_{14}H_{29}MgBr$/diethyl ether solution and the temperature of the reaction system increased to about 20° C. over a ten minute period. The reaction temperature was maintained at approximately 20° C. throughout the remainder of the reaction by immersing the round bottom flask into about 1 inch of an ice water bath. Addition was completed in about 85 minutes.

Afterwards, the reaction system was removed from the ice bath and allowed to warm to room temperature where it was stirred overnight. The reaction was then stopped by pouring the reaction solution onto about 1 liter of cracked ice in a 2 liter beaker while stirring with an air-driven mechanical stirring rod. Optionally, about 500 ml of cracked ice could be used.

One equivalent (based on the product) of HCl, as a concentrated HCl solution, was added to approximately 100 ml of cracked ice and stirred. The resulting solution was poured slowly into the 2 liter beaker containing the reaction product with vigorous stirring. A water layer separated from a diethyl ether layer. The mixture was placed into a separatory funnel and the water layer removed and placed into a separate separatory funnel whereas the diethyl ether layer was retained. The water layer was washed twice with 200 milliliters of diethyl ether and all of the diethyl ether solutions were combined and dried over anhydrous potassium carbonate. The diethyl ether was then removed by stripping at a temperature of about 60° C. and a pressure of about 10 centimeter of mercury. Approximately, 200 milliliters of cyclohexane was then added to azeotrope off any water by stripping at a temperature of about 80° C. and a pressure of about 5 centimeter of mercury. The resulting product was again dissolved in cyclohexane, dried over anhydrous potassium carbonate and the cyclohexane removed by stripping to provide for 105 grams of the title compound (7-methyl-n-heneicosan-7-ol).

By following the procedures set forth above and by substituting the appropriate ketone and bromide reagents, the following additional alkanols were prepared:

| Example No. | Alkanol |
|---|---|
| 2 | $CH_3(CH_2)_4-C(OH)(CH_3)-(CH_2)_4CH_3$ |
| 3 | $CH_3(CH_2)_9-C(OH)(CH_3)-(CH_2)_8CH_3$ |

Other alkanols could also be prepared by the methods set forth above. Such alkanols are used in the preparation of alkylphenols by alkylation of phenol with the alkanol or an olefin. Such alkylation is typically accomplished by use of an acidic alkylation catalyst (e.g., Amberlyst TM 15 or Amberlyst TM 36 sulfonic acid resin both of which are commercially available from Rohm & Haas, Philadelphia, Pa.). Examples 4–9 below illustrate alkylation of phenol using either commercially available alkanols or olefins or the alkanols prepared in Examples 1–3 above.

Example 4

Preparation of Alkylphenol Derived from 10-Methyl-Eicosan-10-ol (Alkanol of Example 3)

Into a 3 liter, 4-neck round bottom flask equipped with a nitrogen source, a thermometer, a mechanical stirrer, and a condenser/Dean-Stark trap was added 848 grams of phenol (melted) and 86.4 grams of Amberlyst TM 15, a sulfonic acid resin alkylation catalyst. The round bottom flask was placed into a heating mantle and the flask purged with nitrogen. Approximately 300 milliliters of Chevron 225 Thinner (available from Chevron U.S.A., Inc., San Francisco, Calif.) was added to the round bottom flask and the system was then heated to about 100° C. under nitrogen.

10-Methyl-eicosan-10-ol (565 grams—from Example 3) was dissolved into approximately 200 milliliters of Chevron 250 Thinner (available from Chevron U.S.A., Inc. San Francisco, Calif.). The resulting solution was added dropwise to the phenol solution over a 30 minute period at about 100° C. The reaction temperature was then carefully controlled at about 120° C. to prevent frothing during which period approximately 200 milliliters of thinner were removed.

The reaction system was refluxed for approximately 5 hours at about 120° C. while collecting water in the Dean-Stark trap. At this point, approximately 39 milliliters of water had collected and was then removed. Alternatively, the water could be pulled off the Dean-Stark trap as it formed to prevent accumulation of water in the trap. The reaction was then brought to room temperature and maintained there overnight. Tlc on silica gel plates (60 volume percent hexane; 20 volume percent acetone; and 20 volume percent methylene chloride) indicated the reaction was complete. Accordingly, the reaction solution was filtered at 70° C. through a celite pad to remove the Amberlyst TM resin. The solvent was then stripped at 100° C. and at a pressure of about 50 mm of Hg; then at 100° C. and at a pressure of about 1–2 mm of Hg; then at 125° C. and at a pressure of about 1–2 mm of Hg; and then for 5 minutes at 170° C. and a pressure of about 1–2 mm of Hg to afford 567 grams of alkylphenol having an average hydroxyl number of 144; a viscosity of about 9.29 cSt at 100° C. and 148 cSt at 40° C.; about 98 weight percent monoalkylation which was about 20 percent ortho substitution and about 80 percent para substitution.

By following the procedures set forth above and by substituting the appropriate ketone and bromide reagents, the following additional alkylphenols were prepared:

Example 5 - $C_9H_{19}C(CH_3)_2$– 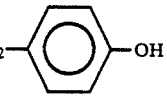 –OH

Example 6 - $C_{18}H_{37}C(CH_3)_2$– 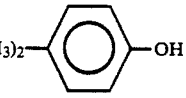 –OH

Example 7 - $(C_5H_{11})_2CCH_3$– 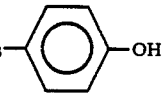 –OH

Example 8 - $(C_{10}H_{21})(C_6H_{13})CCH_3$– 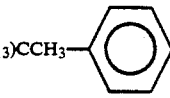 –OH

Example 9 - $(C_{14}H_{29})(C_6H_{13})CCH_3$– 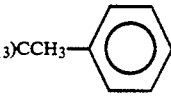 –OH

Data relating to these alkylphenols are set forth below in Table I.

TABLE I

PROPERTIES OF ALKYLPHENOLS

| Alkylphenol of Example | Para Content[1] % | Hydroxyl No. TBAH | Hydroxyl No. AA | Viscosity (cSt) 40° C. | Viscosity (cSt) 100° C. | Alkyl Total Carbon No. | Reaction Conditions: Alkyl Source | Phenol/Alkyl Source Molar Ratio | Temp. °C. | Amberlyst Charge, Wt % |
|---|---|---|---|---|---|---|---|---|---|---|
| 5 | 96 | 206 | 207 | 93 | 6.0 | 12 | A | 5.0/1 | 110 | 6.0 |
| 6 | 89 | 143,144 | 123,123 | (Solid) | 8.4 | 21 | B | 4.8/1 | 115 | 6.0 |
| 7 | 88 | 223,223 | 206,208 | 248 | 8.0 | 12 | Example 2 | 5.0/1 | 110 | 7.3 |
| 8 | 74 | 175,175 | 153,157 | 138 | 8.3 | 18 | C[2] | 5.0/1 | 145 | 6.1 |
| 9 | 86 | 145,148 | 135,138 | 142 | 9.4 | 22 | Example 1 | 5.0/1 | 110 | 6.0 |

A = alkyl group derived from 2-methyl-undecene available from Aldrich Chemical Company, Milwaukee, Wisconsin.
B = alkyl group derived from 2-methyl-2-hydroxy-eicosane available from Wiley Chemical, Columbus, Ohio.
C = alkyl group derived from $C_{18}$ vinylidine olefin available from Chevron Chemical Company, San Ramon, California.
[1]By IR

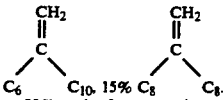

[2]Reported to be 85% $C_6$ $C_{10}$, 15% $C_8$ $C_8$. [1]H NMR analysis indicated 91 mole % vinylidene + 9 mole % internal olefin.
GLPC analysis indicates 90% purity for two major components in the ratio 91 wt %/9 wt %.
TBAH = the art recognized method for determining hydroxyl number using tetrabutylammonium hydroxide titrated to an inflection point.
AA = the art recognized method for determining hydroxyl number using excess acetic anhydride to react with the phenol to form the acetate plus acetic acid and then back titrating the liberated acetic acid to determine the amount of phenol present.

Example 10

Preparation of an Overbased Alkylphenate Composition from the Alkylphenol of Example 6

This example illustrates the preparation of an alkylphenate composition obtained from the alkylphenol of Example 6. In this example, the following components were combined into a reaction flask:

126.5 grams of the alkylphenol of Example 6
36 grams of decyl alcohol
54 grams of CitCon 100N oil
7.2 grams of a monosuccinimide obtained from an alkenyl succinic anhydride having a molecular weight of about 950 in the alkenyl group and from tetraethylene pentaamine
4.2 grams of water.

The contents of the flask were heated to about 90° C. with rapid stirring. At this point, the following additional components were then added:

57.7 grams calcium hydroxide
16.6 grams sulfur

The calcium/alkylphenol mole ratio was 2.60.

The reaction was then heated to about 150° C. and then 33.5 grams of ethylene glycol (0.54 moles) was added dropwise over a 35 minute period via a constant addition funnel (ethylene glycol/alkylphenol mole ratio=1.80). The reaction system was then dehydrated at about 160° C. for 60 minutes and then at about 170° C. for another 60 minutes. At this time, the reaction mixture was carbonated at about 175° C. with 29 grams (0.66 moles) carbon dioxide via a sparge tube over a 70 minute period.

Distillates to this point were about 21 milliliters or 20 grams of material.

The reaction was then stripped at 185° C. and about 0.1 cm of Hg to remove approximately 58 grams of additional distillates.

Part of the crude product (~25 ml) was removed and the remainder of the crude product was diluted with about 200 ml of Chevron 225 thinner and filtered through a celite pad consisting of a 1:1 mixture of Hiflow (a diatomaceous earth filter aid commercially available from Manville Corp., Denver, Colo.) and 512 (a diatomaceous earth filter aid commercially available from Manville Corp., Denver, Colo.). After filtration, the solvent was removed by stripping at about 95° C. and a pressure of about 3 centimeters of Hg to provide for 118 grams of a calcium overbased sulfurized alkylphenate composition having a TBN of 291.

Following the procedures set forth above in Example 10, the following Group II metal overbased sulfurized alkylphenate compositions were prepared as set forth in Table II below.

In Table II below, the phenate of Example 10 was prepared from the alkylphenol of Example 6; the phenate of Example 11 was prepared from the alkylphenol of Example 5; the phenate of Example 12 was prepared from the alkylphenol of Example 7; the phenate of Example 13 was prepared from the alkylphenol of Example 4; the phenate of Example 14 was prepared from the alkylphenol of Example 8; and the phenate of Example 15 was prepared from the alkylphenol of Example 9 respectively.

TABLE II

PROPERTIES OF ALKYLPHENOLS AND CORRESPONDING PHENATES

| Ex | Charge Molar Ratios S/AP | Ca/AP | EG/AP | $CO_2$/AP | Charge[5] CC 100N Wt % | $H_2O$ wt. % | Original TBN[4] | Viscosity (cSt) 100° C. | Viscosity (cSt) 40° C. |
|---|---|---|---|---|---|---|---|---|---|
| 10 | 1.73 | 2.60 | 1.80 | 2.2 | 17.8 | 1.4 | 291[a] | 460[a] | 28,720 |
| 11 | 1.73 | 2.60 | 1.80 | 2.2 | 21.0 | 1.6 | 362[a] | 511[a] | 15,210 |
| 12 | 1.73 | 2.60 | 1.80 | 2.2 | 21.3 | 1.7 | 369[a] | 1352 | TVTM |
| 13 | 1.73 | 2.60 | 1.80 | 2.2 | 18.5 | 1.4 | 317[a] | 438[a] | 11,090 |
| 14 | 1.73 | 2.60 | 1.80 | 2.2 | 19.3 | 1.5 | 298[a] | 79[a] | 1,131 |
| 15 | 1.73 | 2.60 | 1.80 | 2.2 | 18.4 | 1.4 | 306[a] | 273[a] | 5,154 |
| | Diluted | | | | | XRF | XRF | | |

TABLE II-continued

PROPERTIES OF ALKYLPHENOLS AND CORRESPONDING PHENATES

| Ex | TBN[4] | Viscosity (cSt) 100° C. | Viscosity (cSt) 40° C. | $CO_2$ wt. % | S(leco) wght. % | S wght % | Ca wght % | Crude Sediment Vol % |
|---|---|---|---|---|---|---|---|---|
| 10 | — | — | — | — | — | 3.35 | 10.8 | 8.0 |
| 11 | 294 | 57 | 967 | 9.1 | 4.03 | 4.64 | 13.5 | 4.0 |
| 12 | 292 | 99 | 2,943 | 9.0 | 3.69 | 4.2 | 13.4 | 6.0 |
| 13 | 289 | 148 | 2,194 | 6.6 | 1.97 | 2.92 | 11.0 | 6.0 |
| 14 | 292 | 70 | 898 | 8.2 | 2.44 | 3.2 | 11.1 | 8.0 |
| 15 | 291 | 141 | 1,469 | 7.5 | 2.64 | 3.19 | 10.7 | 3.6 |

[3]Made using an alkenyl succinimide as described above at 7.2 g/0.3 moles alkylphenol.
[4]Determined by ASTM Test No. D 2896.
[5]Based on initial charge of Alkylphenol, decyl alcohol, CC100N, alkenyl succinimide, $H_2O$, calcium hydroxide, and sulfur.
[6]average of two runs
S/AP = Sulfur to Alkylphenol mole ratio
Ca/AP = Calcium hydroxide to Alkylphenol mole ratio
EG/AP = Ethylene glycol to Alkylphenol mole ratio
$CO_2$/AP = Carbon dioxide to Alkylphenol mole ratio
S(LECO) % = Percent sulfur using a Leco infrared/combustion instrument available from LECO, Corp. St. Louis, Missouri as Model No. SC32
SXRF wght % = Weight percent sulfur determined by X-ray fluorescence
XRF Ca wght % = Weight percent calcium determined by X-ray fluorescence
TVTM = Too viscous to measure The viscosity at iso-TBN values for the different phenates set forth in Table II are graphically set forth in FIG. 1 which illustrates the correlation of viscosity at a temperature of 100° C. of the Group II metal overbased sulfurized alkylphenate composition with the alkylphenol used to prepare this composition as it relates both to carbon number of the alkyl group as well as whether the alkyl group is attached via an end, skewed or middle attachment.

The results of this figure illustrate that Group II metal sulfurized overbased alkylphenate compositions derived from alkylphenols having substantially straight chain $C_{16}$ to $C_{22}$ skewed alkyl substituents possess the lowest viscosity compared to Group II metal sulfurized overbased alkylphenate compositions derived from alkylphenols having substantially straight chain $C_{16}$ to $C_{22}$ middle or end substituents.

Comparative Example A

Group II metal overbased sulfurized alkylphenate compositions prepared in a manner similar to that set forth in Examples 10–15 above but which employed an alkylphenol derived from propylene tetramer $$(CH_3-\underset{\underset{CH_3}{|}}{CH})_3\underset{\underset{CH_3}{|}}{C}=CH_2$$

generally have higher viscosities at iso-TBN as compared to the Group II metal overbased sulfurized alkylphenate compositions of this invention.

Specifically, 84 grams of an alkylphenol derived from propylene tetramer and having a hydroxyl number of 205 was combined with 36 grams of decyl alcohol and 7.2 grams of a monosuccinimide obtained from an alkenyl succinic anhydride having a molecular weight of about 950 in the alkenyl group and from tetraethylene pentaamine in 54 grams of diluent oil (100 N oil) with 4.2 grams of water.

The temperature of the system was rapidly brought to 90° C. and at 90° C., 57.7 grams of $Ca(OH)_2$ and 16.6 grams of sulfur were added. The system was then heated to about 150° C. and 33.5 grams of ethylene glycol was added dropwise via a constant addition funnel over a 35 minute period. The reaction was dehydrated for 60 minutes at 160° C. then for another 60 minutes at 170° C. The reaction was then brought to 175° C. and carbonated with 29 grams of carbon dioxide at a rate of 24 grams per hours. After carbonation was completed, the reaction was stirred for 10 minutes. The reaction system was stripped for 15 minutes at 185° C. and 27 mm of mercury.

25 ml of crude product was removed and the remainder diluted with 200 ml of Chevron 225 thinner (available from Chevron U.S.A., Inc., San Francisco, Calif.). The resulting solution was filtered through a celite pad consisting of a 1:1 mixture of Hiflow (a diatomaceous earth filter aid available from Manville Corp., Denver, Colo.) and 512 (a diatomaceous earth filter aid available from Manville Corp., Denver, Colo.). The filtered product was then stripped at 90° C. and 3 cm of Hg to provide for 126 grams of a Group II metal overbased sulfurized alkylphenate composition having a TBN of 277.1 mg KOH/gram and a viscosity of 816.1 cSt at 100° C..At a TBN of 290 mg KOH/gram, it is estimated that this composition would have a viscosity of about 1472 cSt.

Example 16

Alternative Preparation of AlkylPhenol

This example illustrates an alternative procedure for alkylating phenol. Specifically, in this example, 1,129.5 grams of phenol and 115.4 grams of Amberlyst 15 (a sulfonic acid resin) were combined into a 5 liter, 4-necked round bottom flask fitted with a stirrer, thermometer, Dean Stark trap/condenser and a nitrogen flow. The flask was then heated to about 130° C. under nitrogen for about 30 minutes.

732.54 grams of a $C_{20}$ to $C_{24}$ alpha olefin mixture (available Chevron Chemical Co., San Ramon, Calif.) was isomerized in two parts: 368 grams of the olefin mixture was isomerized over rhodium trichloride at about 50° C. for about 144 hours; 364.54 grams or the remainder of the alpha olefin mixture was isomerized over iron pentacarbonyl at about 120° C. for about 144 hours. Each olefin mixture was then hot filtered and the compositions combined. The purpose of this step is to isomerize the olefin to an internal (e.g., skewed) position.

The olefin mixture produced above was then heated at about 130° C. to render the composition homogeneous and then the olefin composition was added to the reaction system via a dropping funnel over a 3 minute period while maintaining a nitrogen atmosphere.

The round bottom flask was wrapped in three layers consisting of an internal layer of aluminum foil, a middle layer of glass wool and an outer layer of aluminum foil. The reaction solution was then heated to about 140° C. over a 10 minute period. The reaction solution was maintained at about 140° C. while stirring under nitrogen for about 14 hours. The heat source was then removed and the reaction stirred for overnight. The next morning, the reaction solution was heated to about 80° C. over about a 20 minute period and then stirred for 10 minutes. At this point, the reaction solution was filtered through a fritted glass buchner funnel which was rinsed with about 75 mls of Chevron 225 thinner (available from Chevron U.S.A., Inc., San Francisco, Calif.).

The resulting solution was placed into a 5 liter 4-neck round bottom flask and the solvent distilled therefrom at a temperature of about 135° C. and a pressure of about 20–80 mm of mercury (Hg). Excess phenol was then distilled from the reaction and the temperature increased by about 15° C. every 20 minutes until reaching a temperature of about 165° C. 1,127 grams of phenol were recovered plus the added thinner.

At this point, the product was heated at 165° C. at a pressure of less than about 2.5 mm of Hg for 1 hour to provide for an alkylphenol having a hydroxyl number of 136 (average of two runs).

Having described specific examples of this invention, numerous other Group II metal sulfurized alkylphenate compositions within the scope of this invention could be prepared merely by substituting one or more reagents for the reagents set forth in these examples. For example, other alkaline earth metal compounds can be used to overbase the phenate compositions of this invention include the barium-containing compounds such as barium hydroxide, barium oxide, barium sulfide, barium bicarbonate, barium hydride, barium amide, barium chloride, barium bromide, barium nitrate, barium sulfate, barium borate, etc.; the calcium-containing compounds such as calcium oxide, calcium sulfide, calcium bicarbonate, calcium hydride, calcium amide, calcium chloride, calcium nitrate, calcium borate, etc.; the strontium-containing compounds such as strontium hydroxide, strontium oxide, strontium sulfide, strontium bicarbonate, strontium amide, strontium nitrate, strontium hydride, strontium nitrite, etc.; and the magnesium-containing compounds such as magnesium hydroxide, magnesium oxide, magnesium bicarbonate, magnesium nitrate, magnesium nitrite, magnesium amide, magnesium chloride, magnesium sulfate, magnesium hydrosulfide, etc. The corresponding basic salts of the above-described compounds are also intended; however, it should be understood that the alkaline earth metal compounds are not equivalent for the purposes of this invention, because under certain conditions some are more effective or desirable than others. The calcium salts are presently preferred, particularly calcium oxide, calcium hydroxide and mixtures thereof.

In addition to the above, the amount of carbon dioxide, sulfur, group II metal, etc. can be varied from the examples set forth above to provide for compositions within the scope of this invention.

While the invention has been described in terms of various preferred embodiments, the skilled artisan will appreciate that various modifications, substitutions, omissions, and changes may be made without departing from the spirit thereof. Accordingly, it is intended that the scope of this invention be limited solely by the scope of the following claims, including equivalents thereof.

What is claimed is:

1. A Group II metal overbased sulfurized alkylphenate composition derived from alkylphenols enriched in alkylphenols of formula I:

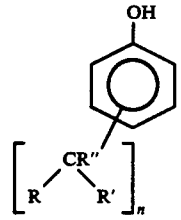

I wherein the —CRR'R'' alkyl substituent is substantially straight chain, R and R' are alkyl groups of at least 3 carbon atoms, R'' is hydrogen, methyl or ethyl and wherein the sum of the number of carbon atoms in R, R' and R'' is from 15 to 21 and further wherein the number of carbon atoms in R' is at least 4 greater than the number of carbon atoms in R; and n is from 1 to 2.

2. The Group II metal overbased sulfurized alkylphenate composition according to claim 1, wherein the number of carbon atoms in R, R' and R'' is from 17 to 21.

3. The Group II metal overbased sulfurized alkylphenate composition according to claim 2, wherein R'' is hydrogen or methyl.

4. The Group II metal overbased sulfurized alkylphenate composition according to claim 1, wherein said Group II metal overbased sulfurized alkylphenate composition is overbased with carbon dioxide and calcium oxide, calcium hydroxide or calcium alkoxide having from 1 to 6 carbon atoms.

5. The Group II metal overbased sulfurized alkylphenate composition according to claim 1, wherein n is 1.

6. A lubricating oil composition comprising an oil of lubricating viscosity and from about 0.5 to about 40 weight percent of a Group II metal overbased sulfurized alkylphenate composition derived from alkylphenols enriched in alkylphenols of formula I:

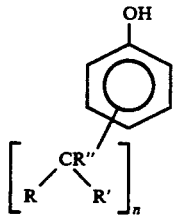

I wherein the —CRR'R'' alkyl substituent is substantially straight chain, R and R' are alkyl groups of at least 3 carbon atoms, R'' is hydrogen, methyl or ethyl and wherein the sum of the number of carbon atoms in R, R' and R'' is from 15 to 21 and further wherein the number of carbon atoms in R' is at least 4 greater than the number of carbon atoms in R; and n is from 1 to 2.

7. A lubricating oil composition according to claim 6, which further comprises:

(a) from about 1 to 20 weight percent of an alkenyl succinimide or alkenyl succinate or mixtures thereof;

(b) about 0.1 to about 4 weight percent of a Group II metal salt of a dihydrocarbyl dithiophosphoric acid; and (c) about 0.3 to about 10 weight percent of a neutral or overbased alkali or alkaline earth metal hydrocarbyl sulfonate or mixtures thereof.

8. The lubricating oil composition according to claim 7, wherein the number of carbon atoms in R, R′ and R″ is from 17 to 21.

9. The lubricating oil composition according to claim 8, wherein R″ is hydrogen or methyl.

10. The lubricating oil composition according to claim 7, wherein said Group II metal overbased sulfurized alkylphenate composition is overbased with carbon dioxide and calcium oxide, calcium hydroxide or calcium alkoxide having from 1 to 6 carbon atoms.

11. The lubricating oil composition according to claim 7, wherein n is 1.

12. In a method for the preparation of a Group II metal overbased, sulfurized alkylphenate composition by reacting in an inert diluent an alkylphenol, sulfur, a Group II metal oxide, hydroxide or $C_1$–$C_6$ alkoxide, a $C_2$–$C_4$ alkylene glycol, an alkanol of at least 8 carbon atoms and a compound selected from the group consisting of an oil-soluble, Group II metal, neutral or overbased, hydrocarbyl sulfonate and an alkenyl succinimide followed by reaction with carbon dioxide wherein the improvement comprises reducing the viscosity of this phenate composition by employing an akylphenol enriched in alkylphenols of formula I:

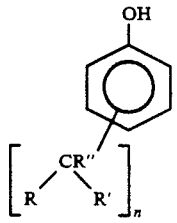

I wherein the —CRR′R″ alkyl substituent is substantially straight chain, R and R′ are alkyl groups of at least 3 carbon atoms, R″ is hydrogen, methyl or ethyl, and wherein the sum of the number of carbon atoms in R, R′ and R″ is from 15 to 21 and further wherein the number of carbon atoms in R′ is at least 4 greater than the number of carbon atoms in R; and n is from 1 to 2.

13. The method according to claim 12, wherein n is 1.

14. A method according to claim 12, wherein said alkylphenol of Formula I is derived from a substantially straight chain internal olefin or alkanol wherein its unsaturation or alcohol substituent at a carbon atom corresponding to a skewed position.

15. The method according to claim 14, wherein said substantially straight chain internal olefin or alkanol is a mixture of olefins and/or alkanols a majority of which mixture comprises more than one $C_{16}$ to $C_{22}$ olefins or alkanols.

16. The method according to claim 15, wherein said mixture is a mixture of $C_{20}$ to $C_{28}$ olefins wherein the majority of said mixture is comprised of $C_{20}$ and $C_{22}$ components.

17. A lubricating oil composition comprising:

(a) an oil of lubricating viscosity;

(b) from 1 to 20 weight percent of an alkenyl succinimide;

(c) about 0.1 to about 4 weight percent of a Group II metal salt of a dihydrocarbyl dithiophosphoric acid;

(d) about 0.3 to about 10 weight percent of a neutral or overbased alkali or alkaline earth metal hydrocarbyl sulfonate or mixtures thereof; and (e) about 1 to about 25 weight percent of a Group II metal overbased sulfurized alkylphenate composition derived from alkylphenols enriched in alkylphenols of formula I:

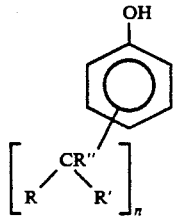

I wherein the —CRR′R″ alkyl substituent is substantially straight chain, R and R′ are alkyl groups of at least 3 carbon atoms, R″ is hydrogen, methyl or ethyl and wherein the sum of the number of carbon atoms in R, R′ and R″ is from 15 to 21 and further wherein the number of carbon atoms in R′ is at least 4 greater than the number of carbon atoms in R; and n is from 1 to 2.

18. The lubricating oil composition according to claim 19, wherein n is one.

19. A lubricating oil composition comprising:

(a) an oil of lubricating viscosity;

(b) a Group II metal overbased sulfurized alkylphenate composition derived from alkylphenols enriched in alkylphenols of formula I:

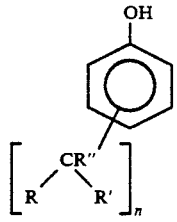

I wherein the —CRR′R″ alkyl substituent is substantially straight chain, R and R′ are alkyl groups of at least 3 carbon atoms, R″ is hydrogen, methyl or ethyl and wherein the sum of the number of carbon atoms in R, R′ and R″ is from 15 to 21 and further wherein the number of carbon atoms in R′ is at least 4 greater than the number of carbon atoms in R; and n is from 1 to 2; and (c) a conventional Group II metal overbased sulfurized alkylphenate composition, wherein the combined amount of the Group II metal overbased sulfurized alkylphenate compositions of (b) and (c) above is from 0.5 to 40 weight percent of the lubricant composition.

20. The lubricating oil composition according to claim 19, wherein n is one.

* * * * *

UNITED STATES PATENT AND TRADEMARK OFFICE

CERTIFICATE OF CORRECTION

PATENT NO. : 5,318,710

DATED : June 7, 1994

INVENTOR(S) : Curtis B. CAMPBELL

It is certified that an error appears in the above-identified patent and that said Letters Patent is hereby corrected as shown below:

In Claim 18, column 3, line 30, please delete "19" and insert therefor --17--.

Signed and Sealed this

Eighth Day of July, 1997

Bruce Lehman

*Attest:*

BRUCE LEHMAN

*Attesting Officer*

*Commissioner of Patents and Trademarks*